US011725797B2

(12) United States Patent
Groene et al.

(10) Patent No.: US 11,725,797 B2
(45) Date of Patent: Aug. 15, 2023

(54) ILLUMINATION DEVICE FOR VEHICLES WITH TEMPERATURE-DEPENDENT ELEMENT FOR CONDENSATION REMOVAL AND/OR DEICING

(71) Applicant: Hella GmbH & Co. KGaA, Lippstadt (DE)

(72) Inventors: Stefan Groene, Brakel (DE); Philipp Lott, Haltern am See (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/735,192

(22) Filed: May 3, 2022

(65) Prior Publication Data

US 2022/0260230 A1 Aug. 18, 2022

Related U.S. Application Data

(63) Continuation of application No. PCT/EP2020/080420, filed on Oct. 29, 2020.

(30) Foreign Application Priority Data

Nov. 4, 2019 (DE) ..... 10 2019 129 592.0

(51) Int. Cl.
*F21S 45/60* (2018.01)
*F21S 41/141* (2018.01)
*F21S 41/20* (2018.01)

(52) U.S. Cl.
CPC ..... *F21S 45/60* (2018.01); *F21S 41/141* (2018.01); *F21S 41/285* (2018.01)

(58) Field of Classification Search
CPC ..... F21S 41/141; F21S 45/285; B60S 1/023
See application file for complete search history.

(56) References Cited

U.S. PATENT DOCUMENTS

2008/0060242 A1* 3/2008 Greer ..... G09F 19/22 40/612
2014/0346377 A1* 11/2014 Willmott ..... G01J 5/0265 250/578.1
2019/0024867 A1* 1/2019 Tsutsumi ..... F21S 45/60

FOREIGN PATENT DOCUMENTS

DE 3936374 A1 5/1991
DE 102010013559 A1 10/2011
(Continued)

OTHER PUBLICATIONS

Machine translation of DE-102011080489-A1, retrieved from worldwide.espacenet.com on Dec. 1, 2022 (Year: 2022).*
(Continued)

*Primary Examiner* — Keith G. Delahoussaye
*Assistant Examiner* — Steven Y Horikoshi
(74) *Attorney, Agent, or Firm* — Muncy, Geissler, Olds & Lowe, P.C.

(57) ABSTRACT

An illuminating device for vehicles, including a housing, in which a light source and an optical unit for generating a predefined light distribution are arranged, including a cover shield, which closes an opening of the housing and through which light passes from an interior of the housing into surroundings, including means for condensation removal and/or deicing of the cover shield, characterized in that the cover shield includes a temperature-dependent light absorber, with the aid of which light is converted into heat depending on the temperature.

10 Claims, 2 Drawing Sheets

(56) References Cited

FOREIGN PATENT DOCUMENTS

| | | | | |
|---|---|---|---|---|
| DE | 202012005627 | U1 | 6/2012 | |
| DE | 102011080489 | A1 * | 8/2012 | ..... F21S 41/13 |
| DE | 102014110841 | A1 | 2/2016 | |
| DE | 102017003398 | A1 | 10/2018 | |
| JP | H04162302 | A | 6/1992 | |
| JP | 2006331650 | A | 12/2006 | |
| WO | WO-2021023620 | A1 * | 2/2021 | ..... B32B 17/10036 |

OTHER PUBLICATIONS

Machine translation of WO-2021023620-A1, retrieved from worldwide.espacenet.com on Dec. 1, 2022 (Year: 2022).*

Robbins et al.,The Temperature Dependence of Rare-Earth Activated Garnet Phosphors, Jul. 1979 (Year: 1979).*

Rejman et al., The Temperature Dependence of CIE-x,y color coordinates in YAG:Ce single crystal phosphor, Feb. 27, 2017 (Year: 2017).*

International Search Report dated Feb. 5, 2021 in corresponding application PCT/EP2020/080420.

* cited by examiner

ILLUMINATION DEVICE FOR VEHICLES WITH TEMPERATURE-DEPENDENT ELEMENT FOR CONDENSATION REMOVAL AND/OR DEICING

This nonprovisional application is a continuation of International Application No. PCT/EP2020/080420, which was filed on Oct. 29, 2020, and which claims priority to German Patent Application No. 10 2019 129 592.0, which was filed in Germany on Nov. 4, 2019, and which are both herein incorporated by reference.

BACKGROUND OF THE INVENTION

Field of the Invention

The present invention relates to an illuminating device for vehicles, including a housing, in which a light source and an optical unit for generating a predefined light distribution are arranged, including a cover shield, which closes an opening of the housing and through which light passes from an interior of the housing into surroundings, including a condensator remover for condensation removal and/or deicing of the cover shield.

Description of the Background Art

An illuminating device for vehicles is known from DE 10 2014 110 841 A1, which includes a housing, in which a light source and an optical unit for generating a predefined light distribution are arranged. An opening arranged at the front in the light emission of the illuminating device is closed by a transparent cover shield. An infrared radiation source is provided for condensation removal and/or deicing of the cover shield, which is arranged on a back side of a reflector of the optical unit. The disadvantage of the known illuminating device is that a further consumer and control electronics are needed for this purpose.

SUMMARY OF THE INVENTION

It is therefore an object of the present invention to provide an illuminating device for vehicles in such a way to provide for condensation removal and/or deicing in a space-saving and cost-effective manner.

To achieve this object, the invention is characterized in that the cover shield includes a temperature-dependent light-absorber, with the aid of which light is converted into heat depending on the temperature.

A temperature-dependent light absorber is integrated into a cover shield, so that, at low temperatures, the light energy introduced by the optical unit into the cover shield is converted into thermal energy. This thermal energy effectuates the deicing or condensation removal of the cover shield at low temperatures. The installation space may be advantageously greatly reduced hereby, since the light absorber is arranged directly on the cover shield and/or within the cover shield. It is advantageously not necessary to activate the light absorber. The light absorber is also transparent, so that the appearance of the illuminating device is not changed. The basic idea of the invention is to act upon the light radiation striking the cover shield during the operation of the illuminating device in such a way that a small portion of the light energy is converted into thermal energy for the condensation removal or deicing of the cover shield, and a large portion of the light energy is allowed to pass through for the purpose of light emission. The invention advantageously permits an automatic conversion of a portion of the light energy provided by the light source into thermal energy for the condensation removal or deicing of the cover shield.

The light absorber can be designed in such a way that an absorptivity of the light absorber is zero or close to zero when a limit temperature is exceeded. This ensures that, above a certain temperature, the full luminous flux is available for generating the light distribution. Below the limit temperature or a limit temperature range, a reduced luminous flux emerges from the cover shield in the light emanation direction, which, however, is selected to be so large that the minimum requirements relating to the illumination intensity is ensured. At a temperature below the limit temperature, a maximum luminous flux is not emitted, but rather the same reduced luminous flux.

The light absorber can be designed in such a way that, in the presence of a temperature of the cover shield below the limit temperature, the absorptivity is in the range of 20% to 80%, preferably 30% to 70%, of the maximum luminous flux. This means that 20% to 80% or 30% to 70%, in particular 50%, of the maximum luminous flux is converted into thermal energy. After deicing or condensation removal of the cover shield, and thus a rise in the temperature of the cover shield, the absorptivity automatically drops toward zero upon exceeding the limit temperature, so that the maximum luminous flux may be output.

The limit temperature can be in the range between 0° C. and 6° C. The limit temperature can be preferably 4° C. A safe deicing of the cover shield is ensured in this manner.

A light source having a light intensity of this type is selected, so that a minimum luminous flux emerges from the cover shield at a temperature of the cover shield below the limit temperature or in an operating temperature range of the vehicle. The legal requirements are advantageously met hereby.

The cover shield can at least partially have a thermochromic layer and/or a thermochromic admixture. For example, the thermochromic layer may be applied as a film, preferably on an inside of the cover shield. The thermochromic layer or the thermochromic admixture may include leuco dyes, a darkening of the cover shield at low temperatures being taken into account.

Further, to achieve also the object, the invention is characterized in that the cover shield includes a temperature-dependent wavelength shifter, with the aid of which spectral components of the light may be partially or completely shifted into an infrared wavelength range depending on the temperature.

The cover shield may include a temperature-dependent wavelength shiftrt, with the aid of which spectral components of the light passing through the cover shield are shifted into an infrared wavelength range. The heat resulting herefrom is used for the condensation removal or deicing of the cover shield.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
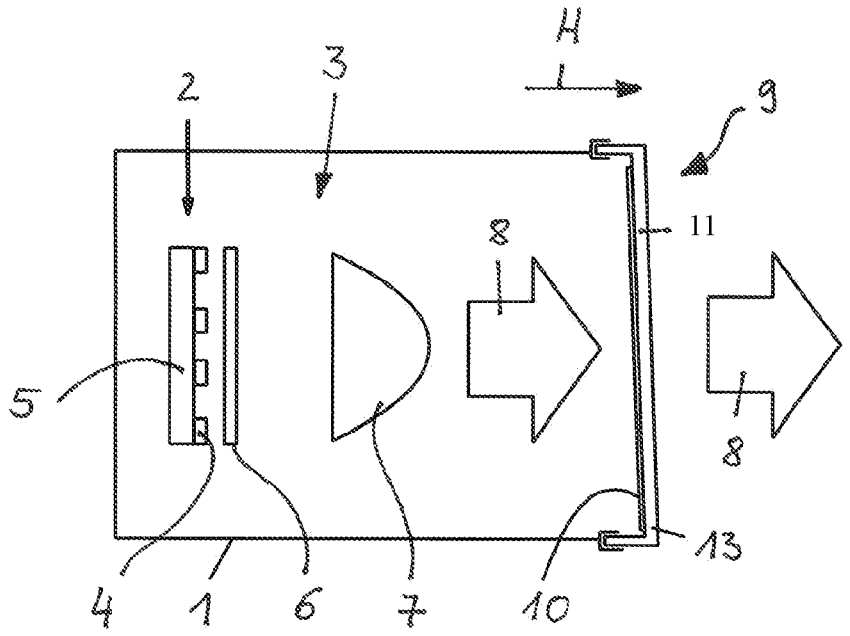
FIG. 1 shows a schematic representation of an illuminating device at a temperature of a cover shield above a limit temperature.
Figure 2:
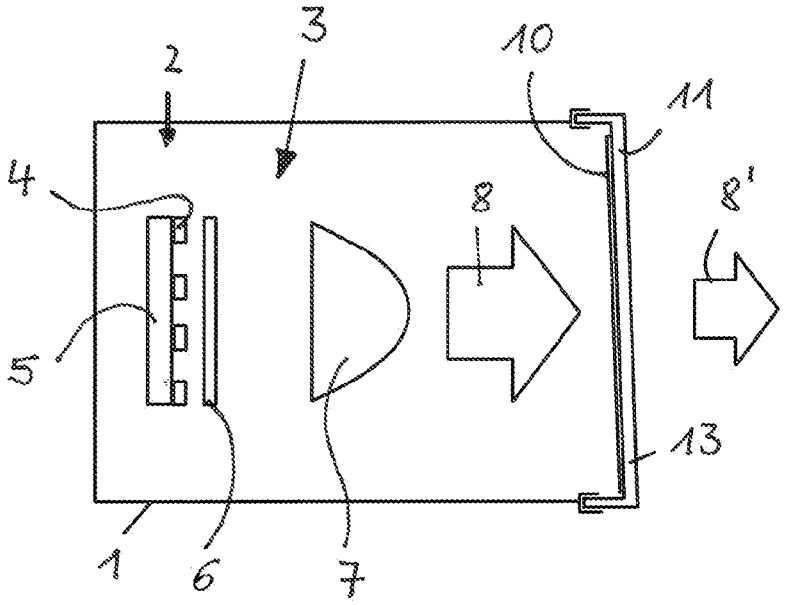
FIG. 2 shows a schematic representation of the illuminating device at a temperature of a cover shield below the limit temperature.

An illuminating device for vehicles can be, for example, a headlamp, which is arranged in a front region of the vehicle, or another light arranged on the vehicle.

The illuminating device includes a housing 1, within which a light source 2 and an optical unit 3 are arranged. In the present exemplary embodiment, light source 2 is made up of a plurality of LED light sources 4, which are arranged on a circuit board 5. Optical unit 3 includes a primary optical element 6 and a secondary optical element 7 arranged upstream from primary optical unit 6 in main emission direction H, with the aid of which luminous flux 8 detected by light source 2 is conducted in the direction of a cover shield 9 covering a front opening of housing 1. Secondary optical element 7 is designed as a lens, which projects the light entering on the side facing light source 2 according to a predefined light distribution, for example a low-beam distribution.

Cover shield 9 is provided with a temperature-dependent light absorber 10, so that luminous flux 8 striking cover shield 9 is partially converted into thermal energy depending on the temperature. The thermal energy heats cover shield 9, so that cover shield 9 may be deiced or condensation removed therefrom. Light absorber 10 is thus used for condensation removal and/or deicing of cover shield 9.

In the present exemplary embodiment, the light absorber is designed as a thermochromic layer 10, which is applied on an inside (flat side) of cover shield 9. The inside of cover shield 9 is arranged on a flat side of cover shield 9 facing optical unit 3.

The thermochromic layer is preferably designed as a film, which is applied to a base material 11 of cover shield 9. Base material 11 may be made from a transparent plastic material which is conventionally used for cover shields 9.

In the present exemplary embodiment, thermochromic layer 10 includes leuco dyes, which result in a darkening of cover shield 9 below a limit temperature $T_G$. The darkening of cover shield 9 effectuates a partial conversion of the light energy provided by light source 2 into thermal energy, so that cover shield 9 is heated.

According to an alternative specific embodiment of the invention, base material 11 of cover shield 9 may also be provided with light absorber 10 only partially on the inside facing optical unit 3. For example, light absorber 10 may be applied in a segmented manner to the inside of cover shield 9, the light absorption segments being preferably evenly distributed over the surface of base material 11. This ensures that a uniform heating of cover shield 9 takes place over the surface thereof.

The light absorption segments may be designed in the shape of strips, rectangles or ovals.

According to a further alternative specific embodiment of the invention, which is not illustrated, light absorber 10 may also be designed as a thermochromic admixture within base material 11. In this specific embodiment, no subsequent application of the light absorber takes place. Instead, the light absorber is introduced into the material of cover shield 9 during the manufacturing of cover shield 9, for example as dye pigments.

Figure 3:
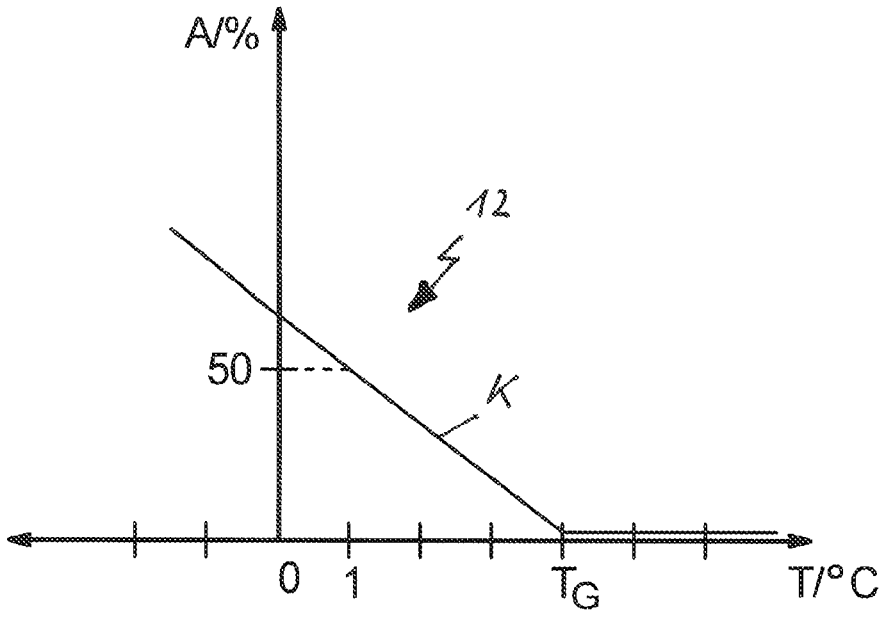
FIG. 3 shows a characteristic of the absorptivity of a light absorber over temperature.

The temperature dependence of light absorber 10 is apparent from FIG. 3. An absorptivity A of light absorber 10 is zero or in the vicinity of zero above a limit temperature $T_G$. Thus, no luminous flux 8 entering cover shield 9 is absorbed above this limit temperature $T_G$. The transmittance of the light is more or less 100%, so that entering luminous flux 8 essentially corresponds to a luminous flux 8 emerging from cover shield 9. Luminous flux 8 is thus not influenced by cover shield 9; cf. FIG. 1.

If a temperature T of cover shield 9 is below limit temperature $T_G$, light absorber 10 is activated after light source 2 is switched on, a portion of luminous flux 8 entering cover shield 9 being absorbed according to an absorption characteristic K in FIG. 3 and being converted into thermal energy. Assuming a temperature T of 1° C., the absorptivity is 50%, so that cover shield 9 allows only a luminous flux 8' to pass through, which corresponds to 50% of luminous flux 8 of entering luminous flux 8.

As is apparent from FIG. 3, absorptivity A increases linearly with a reduction in temperature T, starting at limit temperature $T_G$. The steepness of absorption characteristic K is dependent on the "doping" of light absorber 10 on cover shield 9. The greater the concentration of light absorber 10 on or in cover shield 9, the steeper is the rise in absorption characteristic K.

Limit temperature $T_G$ is 4° C. in the present exemplary embodiment. According to an alternative specific embodiment, limit temperature $T_G$ may also be varied. Limit temperature $T_G$ is preferably in a range between 0° C. and 6° C. Activation range 12, in which light absorber 10 develops its effect, is thus in a range below limit temperature $T_G$, preferably in a temperature range between −2° C. and 6° C. If temperature T is further reduced, light absorber 10 undergoes a saturation.

It is understood that the light intensity of light source 2 is selected in such a way that luminous flux 8' transmitting through cover shield 9 is so great even at low temperature T below limit temperature $T_G$, i.e., within activation temperature range 12 of light absorber 10, so that the minimum legal requirements of a minimum luminous flux are met.

According to a further specific embodiment of the invention, cover shield 9 may be provided with a temperature-dependent wavelength shifter, spectral components of the light being partially and/or completely shifted into an infrared wavelength range depending on the temperature. Instead of a light absorption, a shifting of the spectral color components of the light in the direction of the infrared wavelength range takes place, so that a portion of the luminous flux may be used for heating cover shield 9. With respect to the legal requirements of a minimum luminous flux, the same applies as in the aforementioned exemplary embodiment.

Alternatively or additionally, light absorber 10 may also be arranged on an outside 13 (flat side) of base material 11 or cover shield 9.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An illuminating device for a vehicle, the illuminating device comprising:

a housing, in which a light source and an optical unit to generate a predefined light distribution are arranged;

a cover shield that closes an opening of the housing and through which light passes from an interior of the housing into surroundings; and a temperature-dependent light absorber for condensation removal and/or deicing of the cover shield, wherein the cover shield includes the temperature-dependent light absorber to convert the light into heat depending on a temperature of the cover shield, and wherein the temperature-dependent light absorber is designed as a thermochromic layer applied to the cover shield and/or as a thermochromic admixture which is added to a material of the cover shield.

2. The illuminating device according to claim 1, wherein the temperature-dependent light absorber is designed in such that a light absorptivity is zero or close to zero upon the temperature exceeding a limit temperature.

3. The illuminating device according to claim 2, wherein the limit temperature is in a range between −2° C. and 6° C.

4. The illuminating device according to claim 3, wherein the limit temperature is 4° C.

5. The illuminating device according to claim 1, wherein the temperature-dependent light absorber is designed such that, in the presence of HaThe temperature of the cover shield below a limit temperature, a light absorptivity increases by an absolute value at a reduced temperature.

6. The illuminating device according to claim 1, wherein the temperature-dependent light absorber is designed such that a characteristic of a light absorptivity of the temperature being below 0° C. has a negative gradient in the direction of a limit temperature.

7. The illuminating device according to claim 6, wherein the characteristic of the light absorptivity decreases linearly in the direction of the limit temperature as the temperature increases.

8. The illuminating device according to claim 1, wherein a light intensity of the light source is selected such that, when the temperature of the cover shield is below a limit temperature, a minimum luminous flux emerges through the cover shield into the surroundings.

9. The illuminating device according to claim 1, wherein the thermochromic layer is applied to a flat side of the cover shield.

10. The illuminating device according to claim 9, wherein the thermochromic layer is arranged on an inside of the cover shield.

* * * * *